US009272875B2

(12) United States Patent
Lin

(10) Patent No.: US 9,272,875 B2
(45) Date of Patent: Mar. 1, 2016

(54) STRING-GUIDING STRUCTURE FOR AN AUTOMATIC CURTAIN-REELING DEVICE

(76) Inventor: Shih-Ming Lin, Chiayi (TW)

( * ) Notice: Subject to any disclaimer, the term of this patent is extended or adjusted under 35 U.S.C. 154(b) by 604 days.

(21) Appl. No.: 13/100,331

(22) Filed: May 4, 2011

(65) Prior Publication Data

US 2012/0280072 A1 Nov. 8, 2012

(51) Int. Cl.

| | |
|---|---|
| ***B65H 57/00*** | (2006.01) |
| ***E06B 9/322*** | (2006.01) |
| ***E06B 9/262*** | (2006.01) |

(52) U.S. Cl.

CPC ..... *B65H 57/00* (2013.01); *E06B 9/262* (2013.01); *E06B 9/322* (2013.01); *E06B 2009/2625* (2013.01); *E06B 2009/3222* (2013.01); *E06B 2009/3225* (2013.01)

(58) Field of Classification Search

CPC ..... E06B 2009/3225

USPC ..... 160/84.01, 84.04, 170, 171; 242/371, 242/377, 379, 379.2, 382.1, 384.7, 385, 242/385.1, 397, 97.2, 398, 566, 128, 378.4, 242/388.6

See application file for complete search history.

(56) References Cited

U.S. PATENT DOCUMENTS

| | | | | |
|---|---|---|---|---|
| 2,129,606 | A * | 9/1938 | Nisenson | 160/168.1 R |
| 3,799,236 | A * | 3/1974 | Debs | 160/178.2 |
| 4,327,797 | A * | 5/1982 | Nakajima et al. | 160/168.1 R |
| 4,463,791 | A * | 8/1984 | McClure | 160/178.2 |
| 6,536,503 | B1 * | 3/2003 | Anderson et al. | 160/170 |
| 6,644,375 | B2 * | 11/2003 | Palmer | 160/170 |
| 6,675,861 | B2 * | 1/2004 | Palmer et al. | 160/170 |
| 6,761,203 | B1 * | 7/2004 | Huang | 160/170 |
| 7,025,107 | B2 * | 4/2006 | Ciuca | 160/170 |
| 7,717,154 | B2 * | 5/2010 | Cheng | 160/170 |
| 7,975,748 | B2 * | 7/2011 | Yu et al. | 160/84.05 |
| 8,662,135 | B2 * | 3/2014 | Lin | 160/170 |
| 8,925,615 | B2 * | 1/2015 | Lin | 160/170 |
| 2004/0154758 | A1 * | 8/2004 | Cheng et al. | 160/170 |
| 2006/0065373 | A1 * | 3/2006 | Chen | 160/170 |
| 2006/0096719 | A1 * | 5/2006 | Wu | 160/170 |
| 2006/0283560 | A1 * | 12/2006 | Lai | 160/168.1 R |
| 2008/0000592 | A1 * | 1/2008 | Huang | 160/170 |
| 2008/0099159 | A1 * | 5/2008 | Nien | 160/170 |
| 2008/0202705 | A1 * | 8/2008 | Cheng et al. | 160/170 |
| 2008/0277076 | A1 * | 11/2008 | Cheng | 160/167 R |
| 2010/0206492 | A1 * | 8/2010 | Shevick | 160/170 |

* cited by examiner

*Primary Examiner* — Emmanuel M Marcelo
*Assistant Examiner* — Justin Stefanon
(74) *Attorney, Agent, or Firm* — Alan D. Kamrath; Kamrath IP Lawfirm, P.A.

(57) ABSTRACT

A string-guiding structure for an automatic curtain-reeling device has an arc guiding frame pivotally attached at an entrance for a string corresponding to a connecting pin to extend the string via a limiting space defined between the arc guiding frame and the connecting pin. Therefore, the string is trimmed and depressed to avoid being seized caused by over-rebound or swing of the string and to make the string to work smoothly.

3 Claims, 6 Drawing Sheets

STRING-GUIDING STRUCTURE FOR AN AUTOMATIC CURTAIN-REELING DEVICE

BACKGROUND OF THE INVENTION

1. Field of the Invention

The present invention relates to a string-guiding structure for an automatic curtain-reeling device that has a movable guiding frame to define a limiting space to constrain movement of the string to avoid the string being caught on the reeling device.

2. Description of Related Art

A cordless curtain structure substantially contains an automatic curtain-reeling device on its top rail and makes the blades or curtain to elevate or lower by pulling the string with the automatic curtain-reeling device. Therefore, the cordless curtain structure is safe and convenient in operation.

The conventional automatic curtain-reeling device is composed of two paired guiding wheels meshed by gears. The top side of the two guiding wheels is mounted with an S-shape coil spring, and a bottom side of the two guiding wheels secures two strings winding in counteractive directions. The two guiding wheels with two pivotal shafts respectively and a connecting pin are sandwiched by an upper board and a lower board to compose a stable combination to extend the strings downward to collect the blades or the curtain for the pulling function. Although the user can pull and stop the blade or the curtain at any position, the moving speed of the string is fast (the diameters of the guiding wheels are small so that the rotation speed is fast). Thus, the strings easily get stuck, because the strings violently swing and rebound when they are pulling or collecting. In operation, the strings are wound on the guiding wheels respectively and repeatedly. When the strings are pulled outward or collected inward by rebounding of the S-shaped coil spring, the strings swing rapidly up and down because of the different locations where the strings are mounted on the guiding wheels. When the string swings upward, it easily enters the gear gaps to be caught by the gears. When one string swings downward, it easily falls into the seam between the automatic curtain-reeling device and the top rail and also gets stuck. Therefore, the automatic curtain-reeling device malfunctions in both situations above-mentioned.

SUMMARY OF THE INVENTION

A main objective of the present invention is to provide a string-guiding structure for an automatic curtain-reeling device, which keeps a string smoothly being released or collected without getting seized in operation.

To achieve the foregoing objectives, the string-guiding structure for an automatic curtain-reeling device comprises two pivotal holes defined on two boards respectively corresponding to a connecting pin at an entrance of a string of an automatic curtain-reeling device to allow two ends of an arc guiding frame engaging the pivotal holes respectively; with the arc guiding frame rotated to lean against the connecting pin to define a limiting space for penetration of the string.

Further benefits and advantages of the present invention will become apparent after a careful reading of the detailed description with appropriate reference to the accompanying drawings.

DETAILED DESCRIPTION OF THE PREFERRED EMBODIMENTS

A string-guiding structure for an automatic curtain-reeling device in accordance with the present invention substantially has an arc guiding frame pivotally attached at an entrance for a string corresponding to a connecting pin to extend the string via a limiting space defined between the arc guiding frame and the connecting pin. Therefore, the string is trimmed and depressed to avoid being seized caused by over-rebound or swing of the string and thus to make the string work smoothly.

Figure 1:
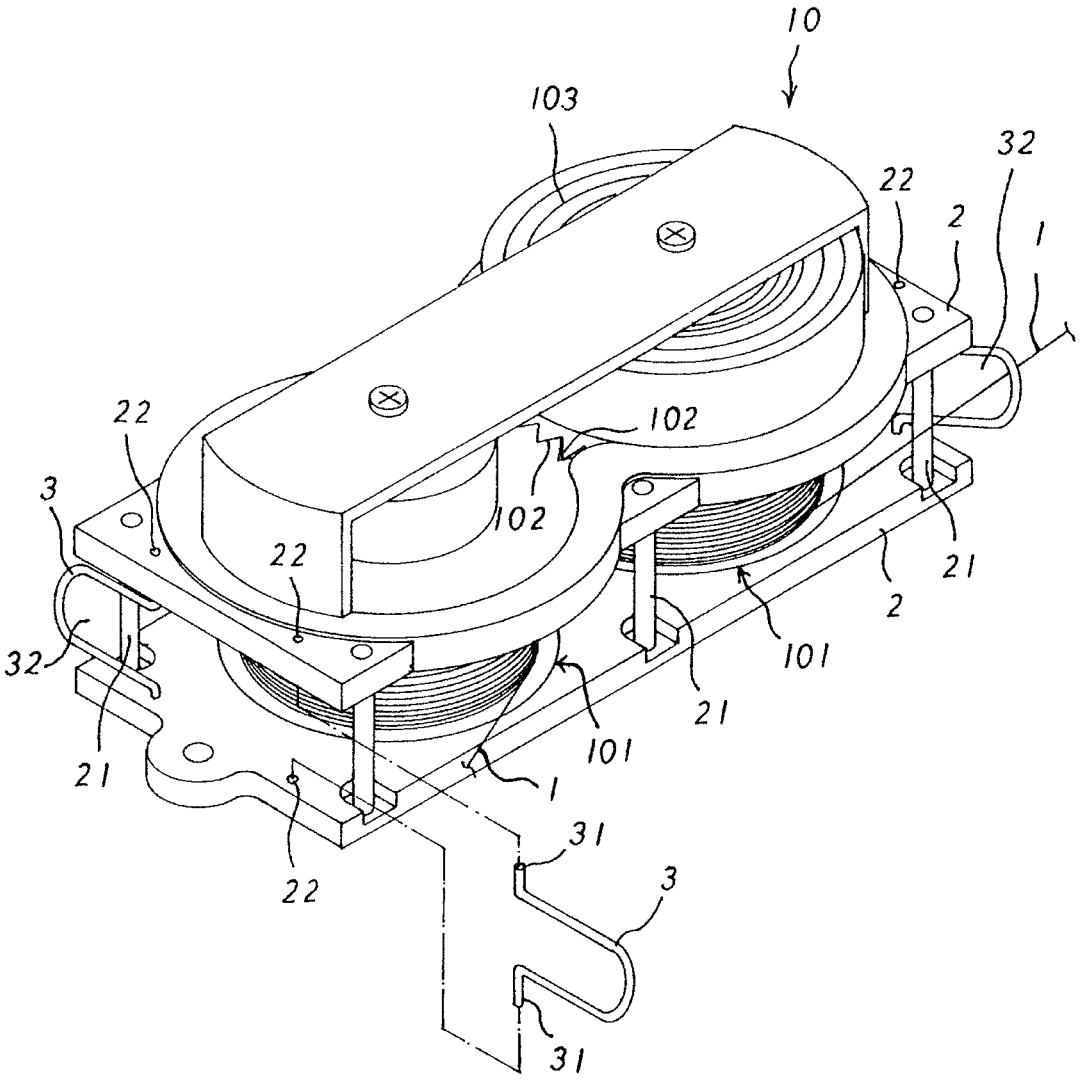
FIG. 1 is a perspective view of one embodiment of a string-guiding structure for an automatic curtain-reeling device in accordance with the present invention, with an arc guiding frame detached therefrom.
Figure 2:
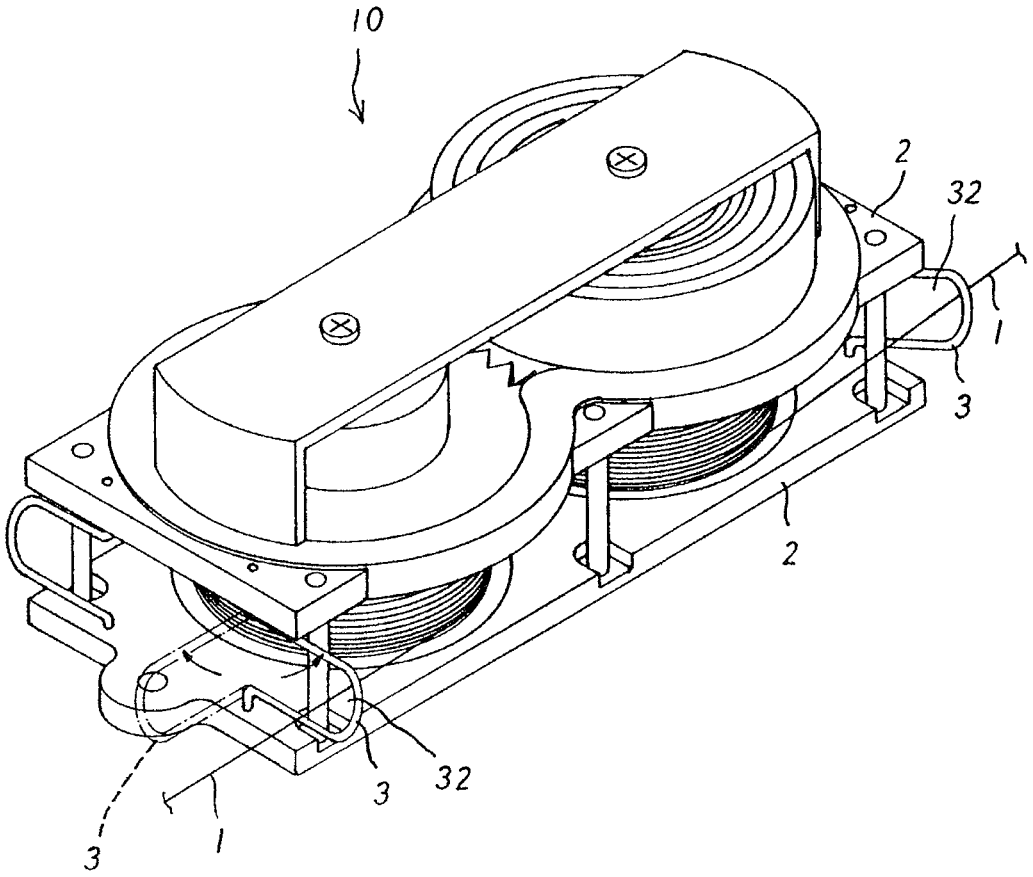
FIG. 2 is a perspective view of the string-guiding structure for an automatic curtain-reeling device, with the arc guiding frame pivotally attached thereto.

With reference to FIGS. 1 and 2, a preferred embodiment of the string-guiding structure for an automatic curtain-reeling device in accordance with the present invention substantially comprises two pivotal holes 22 defined on two boards 2 respectively (as shown in FIG. 1) corresponding to a connecting pin 21 at an entrance of a string 1 of an automatic curtain-reeling device 10 to allow two ends 31 of an arc guiding frame 3 in a horseshoe shape to engage the pivotal holes 22.

By having the above elements, the arc guiding frame 3 is pivotally secured between the two boards 2 and movable so that the arc guiding frame 3 is rotated to abut the connecting pin 21 to define a limiting space 32 (the limiting space 32 is the protruding area after the arc guiding frame 3 leans against the connecting pin 21), and the string 1 extends outward via the limiting space 32. Therefore, the connecting pin 21 and the arc guiding frame 3 provide a guiding efficiency for the string 1 (as shown in FIG. 2).

Figure 3:
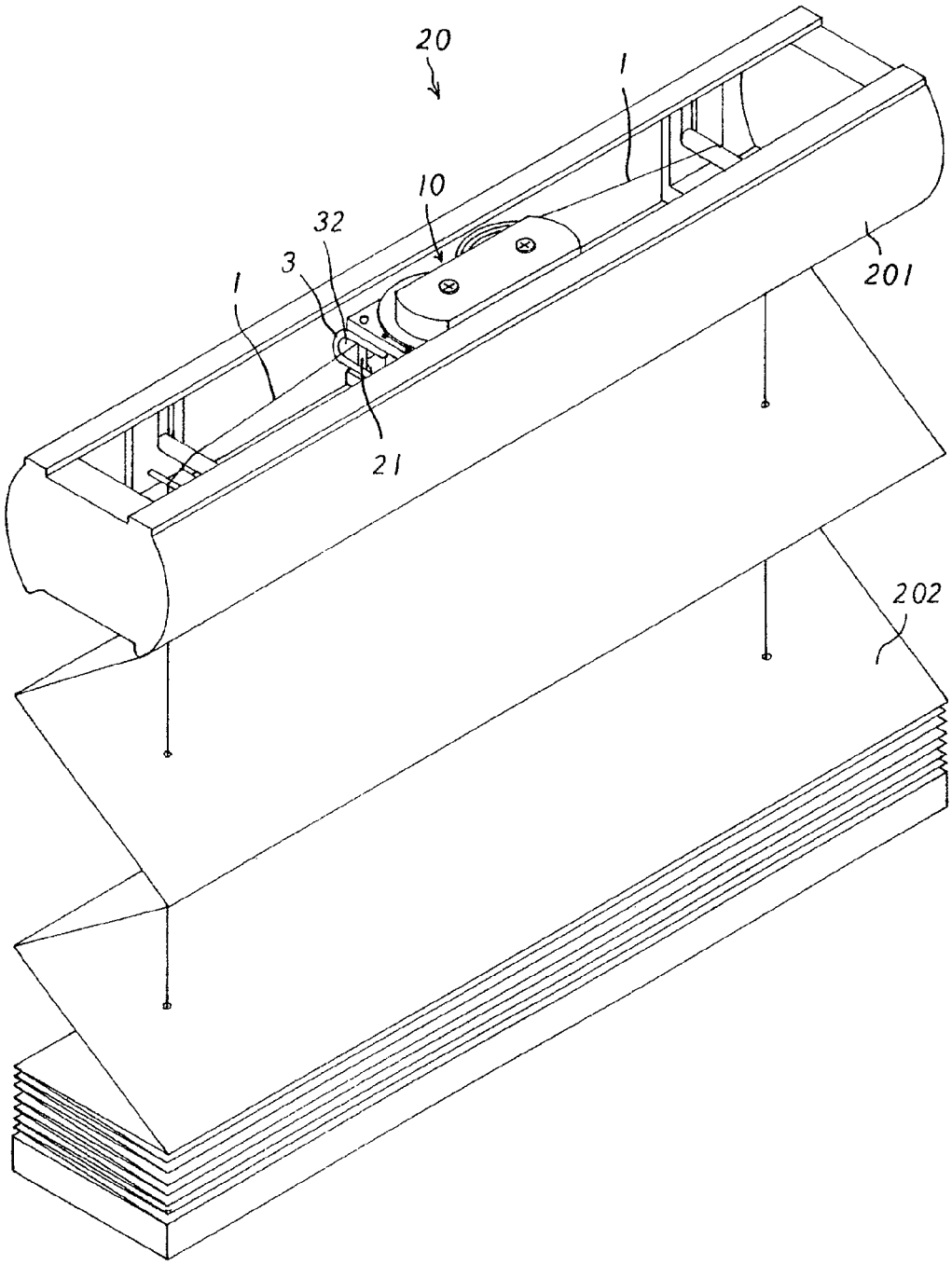
FIG. 3 is a schematic perspective view showing that the string-guiding structure for an automatic curtain-reeling device is mounted on a top rail of a curtain assembly.
Figure 4:
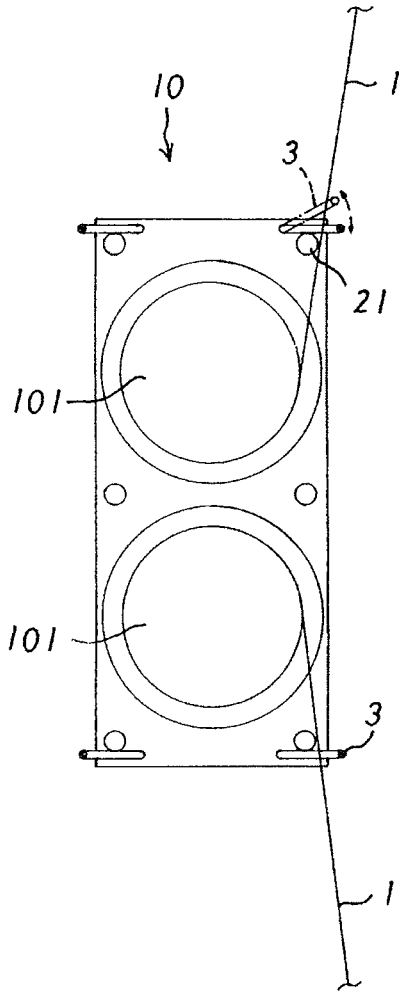
FIG. 4 is a cross-sectional top view of the string-guiding structure for an automatic curtain-reeling device in FIG. 2.
Figure 5:
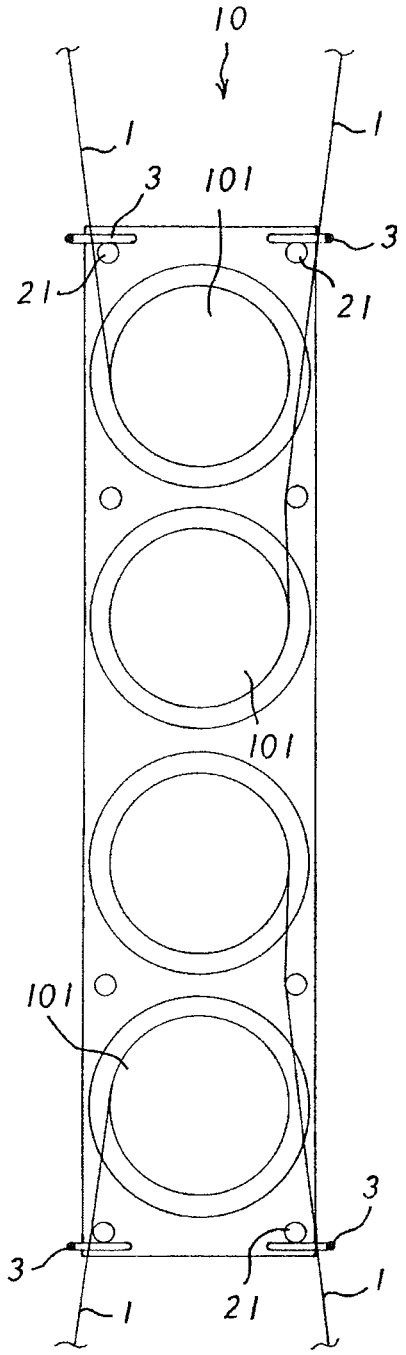
FIG. 5 is a cross-sectional top view showing modification of the string-guiding structure for an automatic curtain-reeling device in accordance with the present invention.

When the string-guiding structure for an automatic curtain-reeling device is in use, the automatic curtain-reeling device 10 is mounted on a top rail 201 of a curtain assembly 20. The automatic curtain-reeling device 10 is interiorly composed of two guiding wheels 101 paired and meshed by gears 102. A top side of the two guiding wheels 101 is mounted with a S-shape coil spring 103, and a bottom side of the two guiding wheels 101 secures two strings 1 winding in counteractive directions on the two guiding wheels 101 respectively. The two guiding wheels 101 and the connecting pins 21 are sandwiched by the two boards 2 to compose a stable combination to extend the strings 1 downward via the limiting space 32 defined between the connecting pin 21 and the arc guiding frame 3 to collect a curtain 202 (or blades) for a pulling function (as shown in FIG. 3). Therefore, when a user elevates or lowers the curtain 202 (or blades), the swing up-and-down or rebound right-and-left of the string 1 caused by the quick release or collection is depressed by the limiting space 32 to significantly diminish the swing and rebound range of the string 1 (as shown in FIGS. 4 and 5, with FIG. 5 multiple guiding wheels 101 for reference) to prevent the string 1 from being caught by the gears 102 or falling into seams between the automatic curtain-reeling device and the top rail because of the swing.

Figure 6:
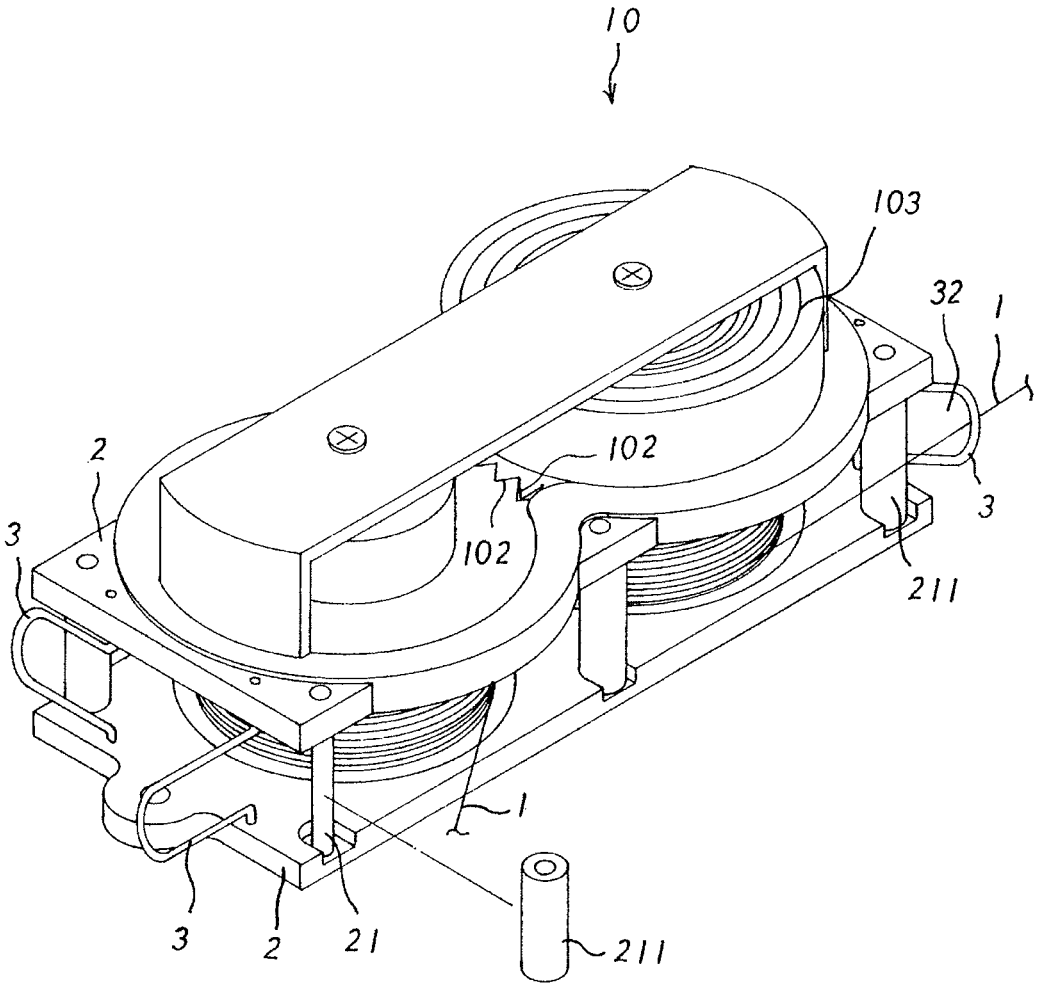
FIG. 6 is perspective view of another embodiment of the string-guiding structure for an automatic curtain-reeling device in FIG. 5, with the string-guiding device further having multiple sleeves.

Moreover, the string-guiding structure further has a sleeve 211 mounted to each of the connecting pin 21 to make the contact between the string 1 and the connecting pin 21 become smoother (as shown in FIG. 6) and thus to increase guiding efficiency to the string 1.

Moreover, the two ends 31 of the arc guiding frame 3 are pivotally attached between the two boards 2 to allow the arc guiding frame 3 to enter a gap between the two boards 2 to correspondingly diminish the swing up-and-down range for the string 1 to efficiently prevent the string 1 from being seized. (Especially when the height of the guiding wheels 101 between the two boards 2 is high to accommodate more wound string 1 but increases the swing degree. This modification eases such situation easily.)

According to above description, the string-guiding structure has the following advantages:

1. By setting the arc guiding frame 3 pivotally between the two boards 2 and movable, the arc guiding frame 3 can be rotated to abut the connecting pin 21 to define the limiting space 32 to extend the string 1 outward via the limiting space 32. Therefore, the swing up-and-down or rebound right-and-left of the string 1 caused by the quick release or collection is depressed by the limiting space 32 to significantly diminish the swing and rebound of the string 1 to prevent the string 1 from being caught by the gears 102 or falling into seams between the automatic curtain-reeling device and the top rail caused by swing.

2. By setting the sleeve 211 around the connecting pin 21, contact between the string 1 and the connecting pin 21 becomes smoother to increase guiding efficiency to the string 1. Moreover, the arc guiding frame 3 is pivotally mounted between the two boards 2 to diminish the swing up-and-down range after penetrating the string 1, so that the string 1 is efficiently prevented from being caught accidently.

Although this invention has been described in its preferred forms with a certain degree of particularity, it is understood that the present invention of the preferred forms has been made only by way of example and that numerous changes in the details of construction and the combination and arrangement of parts may be resorted to without departing from the spirit and scope of the invention.

What is claimed is:

1. An automatic curtain-reeling device comprising:

two boards in a spaced parallel relation;

a guide wheel rotatably mounted between the two boards about a wheel axis perpendicular to the two boards;

a string wound on the guide wheel;

a connecting pin extending between and connected to the two boards spaced from the guide wheel and parallel to the wheel axis;

two pivotal holes extending through the two boards respectively corresponding to the connecting pin at an entrance;

an arc guiding frame of a horseshoe shape having two free ends, with the two free ends extending in opposite directions from the horseshoe shape, with the two free ends pivotally received in the two pivotal holes respectively, with the arc guiding frame being pivotal about a frame axis extending through the two free ends and parallel to and spaced from the wheel axis and parallel to and spaced from the connecting pin and relative to the two pivotal holes and the two boards;

wherein the arc guiding frame is rotatable between a first position abutting against the connecting pin and a second position angularly spaced from the first position and the connecting pin; and a limiting space defined by the arc guiding frame and the connecting pin within the arc guiding frame, with the connecting pin being intermediate the limiting space and the two pivotal holes, with the string extending from the guide wheel through the arc guiding frame and through the limiting space with the connecting pin located intermediate the two free ends and the string extending through the limiting space.

2. The string-guiding structure as claimed in claim 1, further comprising a sleeve of a tubular shape with annular cross sections rotatably mounted on the connecting pin between the two boards for rotation about a sleeve, axis, spaced from and parallel to the wheel axis and the frame axis to make contact of the string and the connecting pin smooth.

3. The string-guiding structure as claimed in claim 1, wherein each of the two ends of the arc guiding frame is pivotally attached to the two boards about the frame axis to allow the arc guiding frame to enter a gap between the two boards.

* * * * *